US006488189B1

(12) United States Patent
Smith

(10) Patent No.: US 6,488,189 B1
(45) Date of Patent: Dec. 3, 2002

(54) BACKPACKS, SHOULDERS BAGS AND BRIEFCASES

(75) Inventor: Wendell M. Smith, Smiths (BM)

(73) Assignee: Polestar Ltd. (BM)

( * ) Notice: Subject to any disclaimer, the term of this patent is extended or adjusted under 35 U.S.C. 154(b) by 0 days.

(21) Appl. No.: 09/663,299

(22) Filed: Sep. 15, 2000

Related U.S. Application Data

(63) Continuation-in-part of application No. 09/483,554, filed on Jan. 15, 2000, now abandoned.

(51) Int. Cl.[7] ..... A45F 3/10

(52) U.S. Cl. ..... 224/201; 224/578; 224/580; 224/628; 224/629

(58) Field of Search ..... 224/153, 578, 224/579, 580, 584, 585, 586, 201, 628, 629, 631

(56) References Cited

U.S. PATENT DOCUMENTS

| | | | | | |
|---|---|---|---|---|---|
| 504,101 | A | * | 8/1893 | Zbinden | 224/201 |
| 2,960,137 | A | * | 11/1960 | Lipsitz | 150/108 |
| 3,802,613 | A | * | 4/1974 | Droeger | 224/153 |
| 3,881,644 | A | * | 5/1975 | Demaline | 224/153 |
| 4,194,602 | A | * | 3/1980 | Allen | 224/235 |
| 4,763,763 | A | * | 8/1988 | Sadow | 150/108 |
| 5,222,641 | A | * | 6/1993 | Medeiros, Jr. | 224/161 |
| 5,415,332 | A | * | 5/1995 | Kliot | 150/106 |
| 5,431,317 | A | * | 7/1995 | Kliot | 224/153 |
| 5,509,590 | A | * | 4/1996 | Medeiros et al. | 224/161 |
| 5,881,932 | A | * | 3/1999 | Wadden | 150/108 |
| 6,286,461 | B1 | * | 9/2001 | Martz | 119/497 |

* cited by examiner

*Primary Examiner*—Stephen K. Cronin
(74) *Attorney, Agent, or Firm*—St. Onge Steward Johnston & Reens LLC

(57) ABSTRACT

A device for carrying items comprising a frame having an upper end and a lower end. A substantially rigid briefcase is hingedly connected to the lower end of the frame and movable between an open position wherein the briefcase is substantially perpendicular to the frame and a closed position wherein the case is substantially parallel and adjacent to the frame. The briefcase includes a strap attached to a side thereof wherein the strap permits the carrying of the briefcase on a first shoulder of a user of the device A handle connected to the frame at said upper end is movable between a first position and a second position wherein the first position permits carrying of the briefcase using the handle and the second position permits the handle to be placed over a second shoulder of the user.

29 Claims, 7 Drawing Sheets

BACKPACKS, SHOULDERS BAGS AND BRIEFCASES

PRIOR APPLICATION

This application is a continuation-in-part of previously filed U.S. patent application Ser. No. 09/483,554 filed Jan. 15, 2000 now abandoned.

FIELD OF THE INVENTION

The invention relates to backpacks, briefcases, and related devices for carrying items.

BACKGROUND OF THE INVENTION

Backpacks and shoulder bags or briefcases have been the most popular and effective way to carry medium to heavy loads while walking. They were originally developed for military and exploring activities and have, over time, become very stylish and popular for students and chic designer models for women's wear and are showing up in cities around the world.

Backpacks are usually designed with two balanced soft straps, one for each shoulder. These straps work very well and are lightweight and soft on the shoulders, smoothly sharing the load in the center of the back. There are several problems created by the two soft straps. One is the difficulty in getting the pack onto both the shoulders and moving the second soft strap into place on the shoulder of the packer. The difficulty increases with load and with layers and "stickiness" of clothing. Another problem exists in that the shape, bulk and length of the straps place great limitations on the style of packs.

The result of the problem is that one either needs help in getting the pack mounted, or, as so often seen in the school yard, must implement a casual one shoulder use of the pack, which creates an unbalanced load on the back which can lead to painful neck and back problems. The latter result is also produced by bags or briefcases having no straps or a single strap which also places a similarly unbalanced load on the back. An unbalanced load is detrimental to back mechanics. These bags or briefcases also suffer the disadvantage that when users become more active, such as when bicycling or roller blading, the one shoulder cannot be used as the case bobs alongside the body or falls off the single shoulder.

What is desired, therefore, is an improved handle for a pack that would allow the user to pick it up like a briefcase, then whenever ready, even after loading one strap onto a shoulder, to be able to use the handle as the second strap to balance the pack while avoiding the friction and sliding action over the arms. What is also desired is a pack or briefcase that can be used to carry an amount of items larger than the capacity of the case itself.

SUMMARY OF THE INVENTION

Therefore, it is an object of the invention to provide an improved lifting handle and a load-balancing second strap which is easy to place on the shoulder.

It is a further object of the invention to provide a pack with a handle having the dual purpose of acting as a lifting handle and as a load-balancing second strap.

Another object of the invention is to provide an unobtrusive second strap which does not have a handle or other obtrusive element to the design, but permits the wearer to balance the load when necessary or as desired.

Yet another object of the present invention is to provide a briefcase having the above features that can be used as a vehicle for transporting or carrying additional items.

These and other objects of the invention are achieved by provision of a device for carrying items comprising a frame having an upper end and a lower end. A substantially rigid briefcase is hingedly connected to the lower end of the frame and movable between an open position wherein the briefcase is substantially perpendicular to the frame and a closed position wherein the case is substantially parallel and adjacent to the frame. The briefcase includes a strap attached to a side thereof wherein the strap permits the carrying of the briefcase on a first shoulder of a user of the device. A handle connected to the frame at said upper end is movable between a first position and a second position wherein the first position permits carrying of the briefcase using the handle and the second position permits the handle to be placed over a second shoulder of the user. Preferably, the device further comprises a telescoping component connecting the handle to the frame wherein the telescoping component permits the handle to be moved from a retracted position to an extended position away from said briefcase. The device preferably further includes wheels attached to the lower end of said frame or the briefcase to permit rolling of said device.

The objects of the invention are further achieved by the provision of a pack for transporting items comprising a compartment for holding items including a closable opening for permitting the insertion and removal of items, a first strap attached to the compartment for carrying the pack on a first shoulder of a user of the pack, and a second strap attached to the compartment movable between a first position and a second position wherein said first position permits said second strap to be located so as to permit said second strap to act as a handle for said pack and said second position permits said second strap to be placed over a second shoulder of the wearer to balance the pack. Preferably, the second strap is attached to the compartment at a first end of the second strap via a rotatable pivot joint and a latching mechanism attached to the pack secures the second end of the second strap while the second strap is in the first position.

The invention and its particular features and advantages will become more apparent from the following detailed description considered with reference to the accompanying drawings.

DETAILED DESCRIPTION OF THE DRAWINGS

Figure 2:
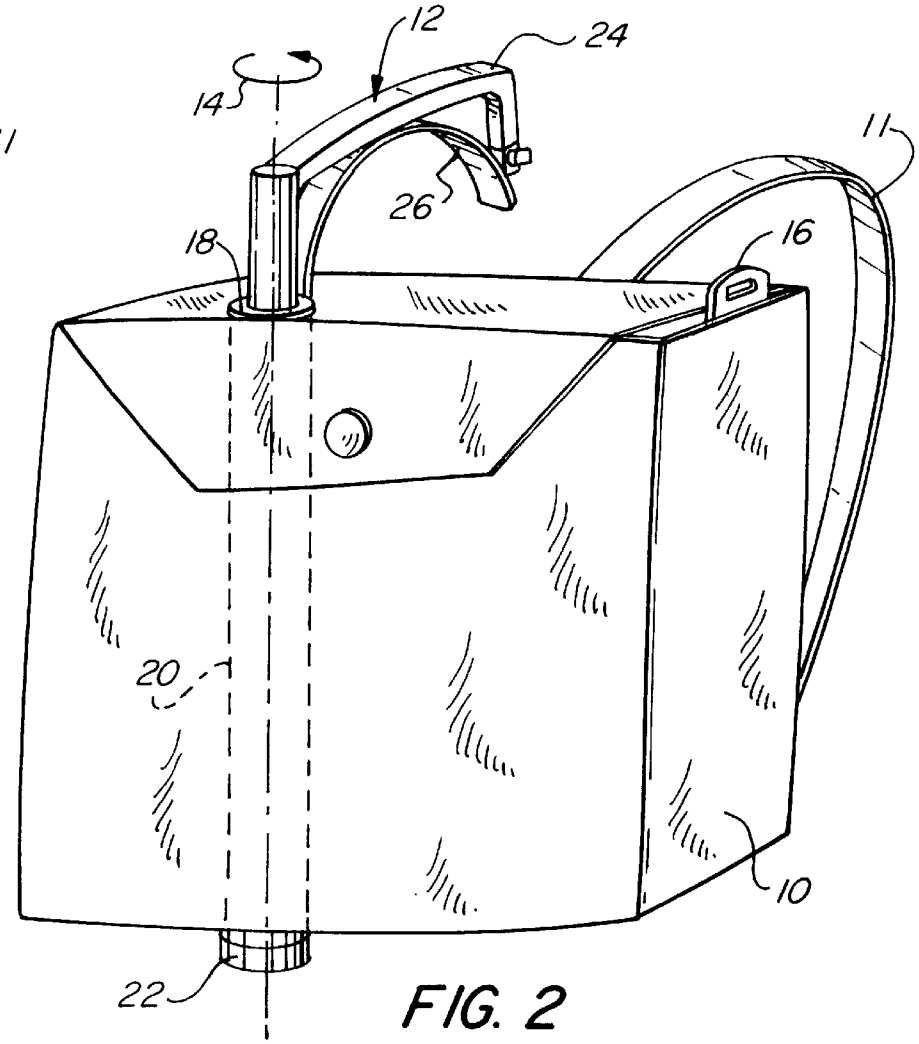
FIG. 2 is a perspective view of the pack of FIG. 1 showing the second strap in its second position.
Figure 1:
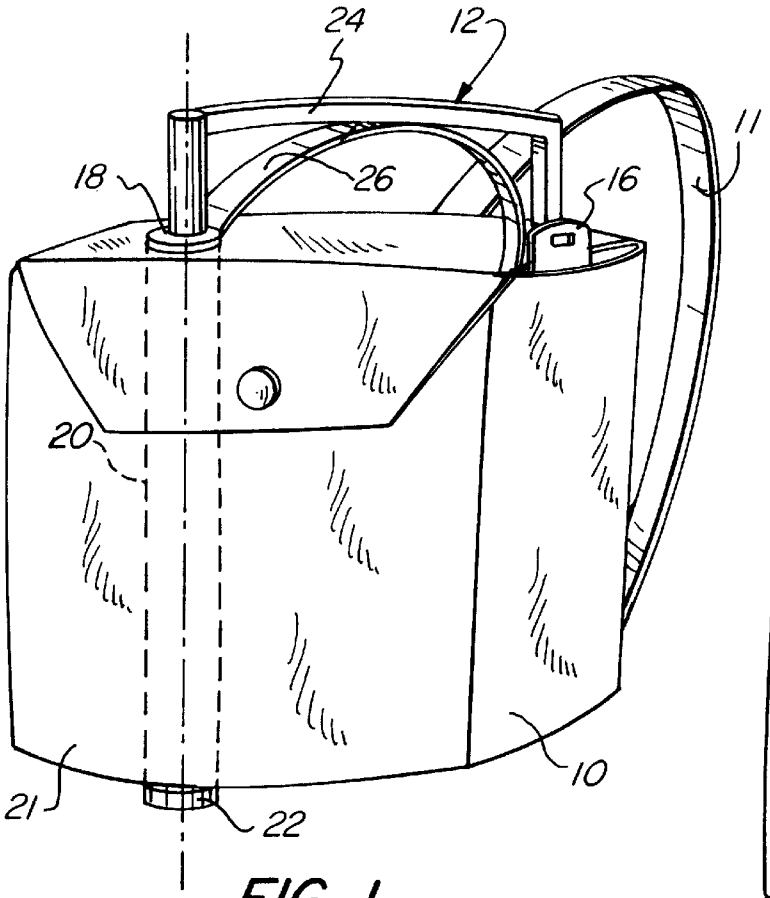
FIG. 1 is a perspective view of a pack in accordance with the invention showing the second strap in its first position.

FIGS. 1 and 2 depict a pack 10 in accordance with the invention. The pack 10 may be any type of device having an at least partially closeable compartment for carrying items, such as a backpack, shoulder bag or briefcase. The pack 10 includes a first strap 11 attached to the pack 10. The first strap 11 fits over the shoulder of the user 40 permitting the pack 10 to be supported on the user's shoulder. The pack 10 further includes a second strap 12. The second strap 12 is movable between a first position, shown in FIG. 1, and a second position, shown in FIG. 2. In the first position, the second strap 12 may be used as a handle to permit the user 40 to lift and carry the pack 10 with a hand. In the second position, the second strap 12 may be placed over the user's other shoulder to balance the weight of the pack 10 on both shoulders of the user 40.

To enable the second strap 12 to be moved from the first position to the second position, the second strap 12 is attached to the pack 10 at a first end of the second strap via a rotatable pivot joint 18 that permits the second strap 12 to be rotated about an axis shown by the arrow 14. If desired, the pack 10 may include an internal shaft 20 passing through the pack 10 and having an upper and lower end. The shaft 20 is attached to the second strap 12 at its upper end by way of the pivot joint. The shaft terminates in a knob 22 at its lower end near the bottom 21 of the pack 10 to enable the user 40 to more conveniently rotate the second strap 12 between positions. Typically, the second strap 12 is rotated to the second position after the first strap 11 is placed on a user's shoulder. Preferably, the pack 10 also includes a latching mechanism 16 attached to the pack 10 for securing the second end of the second strap 12 while the second strap 12 is in the first position. Use of a latching mechanism 16 prevents unwanted rotation of the second strap 12 while the user 40 is carrying the pack 10 using the second strap 12 as a handle.

As shown in FIG. 1, the second strap 12 may include a rigid portion 24 and a soft portion 26. The rigid portion 24 transmits the load of the pack 10 from the user's shoulder to the pack 10 while soft portion 26 improves the comfort of the second strap 12 to the user 40. It is to be understood that the second strap 12 may be of any construction that permits the second strap 12 to hookover the shoulder of the user 40 and support the load of the pack 10 thereon.

Figure 4:
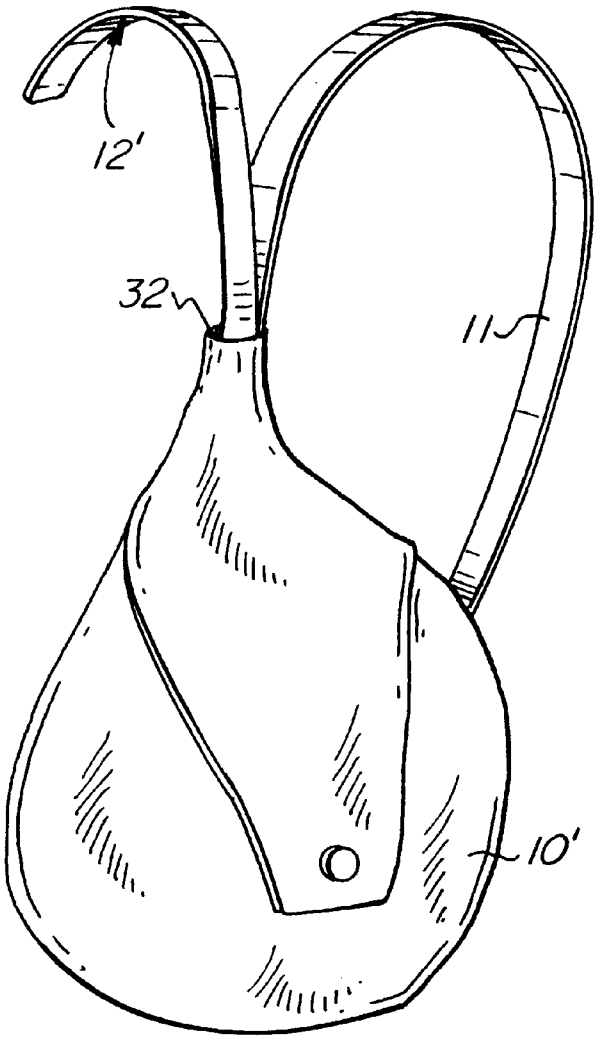
FIG. 4 is a perspective view of the pack of FIG. 3 showing the second strap in the second position.
Figure 3:
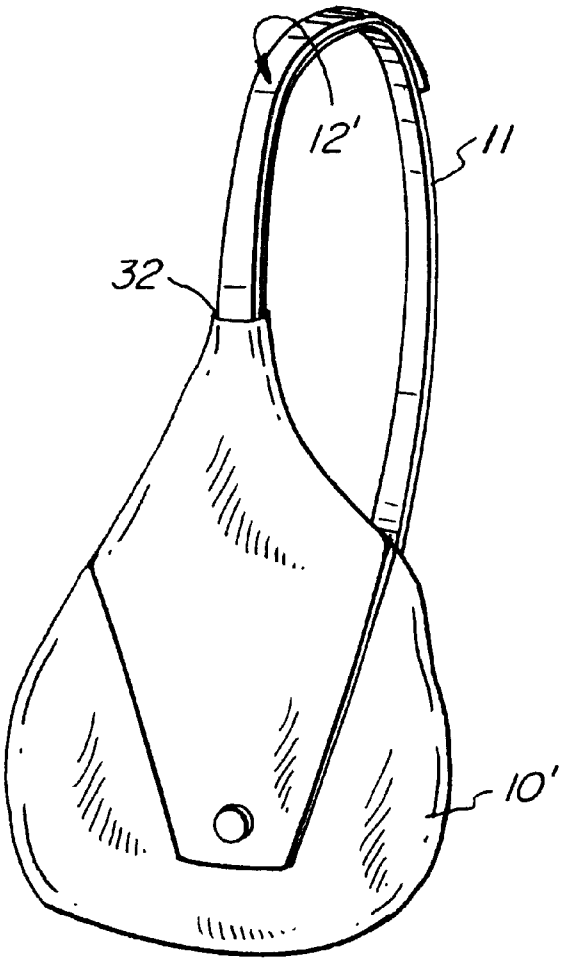
FIG. 3 is a perspective view of an embodiment of the pack of FIG. 1 showing the second strap in the first position.

FIGS. 3 and 4 depict an embodiment wherein the pack 10 is a shoulder bag 10' in accordance with the invention. In bag 10', the second strap 12' is combined together with the first strap 11 when the second strap 12' is in the first position. Thus, the second strap 12' may be discreetly stowed when in the first position and not in use instead of functioning as a separate handle as described above. Accordingly, bag 10' need not include an internal shaft 20 or knob 22 for rotating the second strap 12' as described above. In this embodiment, the first and second straps 11, 12' originate at a common attachment point 32 on the bag 10'. The first strap 11 may be any strap commonly found on shoulder bags. The second strap 12' is removably attached to the first strap 11 so that it may be easily detached from the first strap 11 and hooked over the user's other shoulder to balance and distribute the load of the bag 10' on both of the user's shoulders. As such, the second strap 12' need be sufficiently resilient to support the load of the bag 10' without releasing from the user's shoulder.

Figure 5:
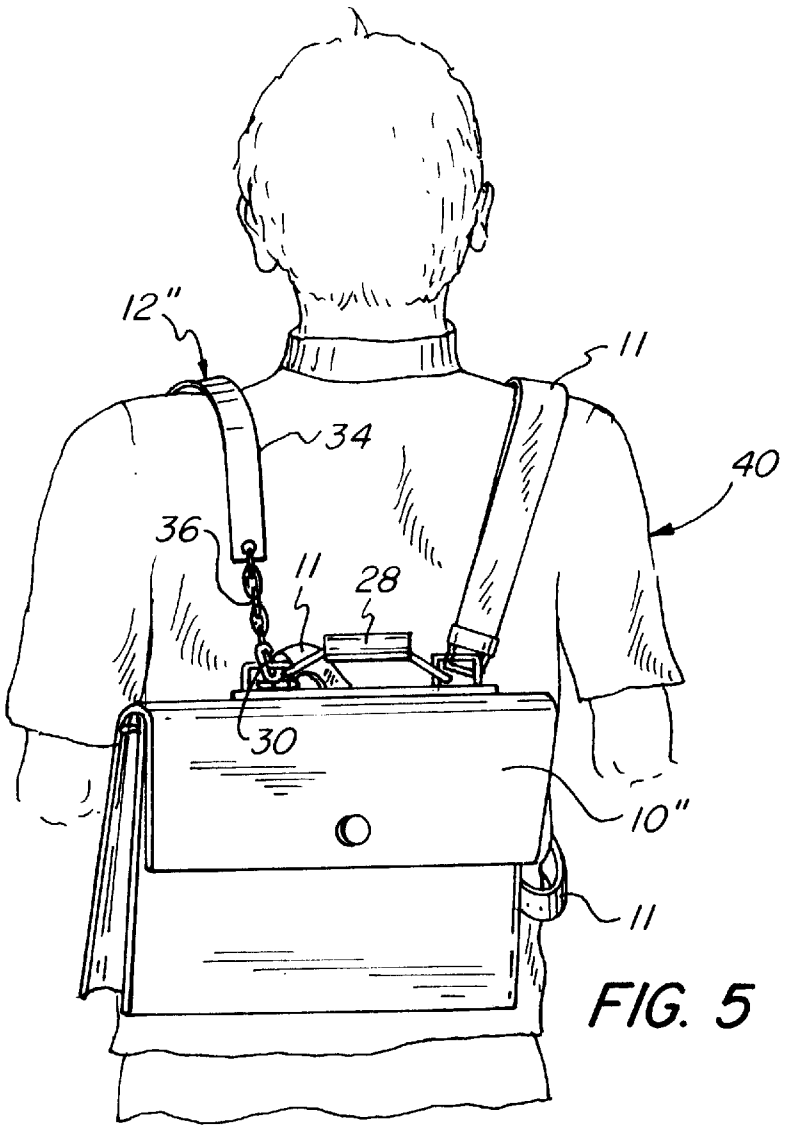
FIG. 5 is a perspective view of another embodiment of the pack of FIG. 1 showing the second in the second position as it would appear in use.
Figure 6:
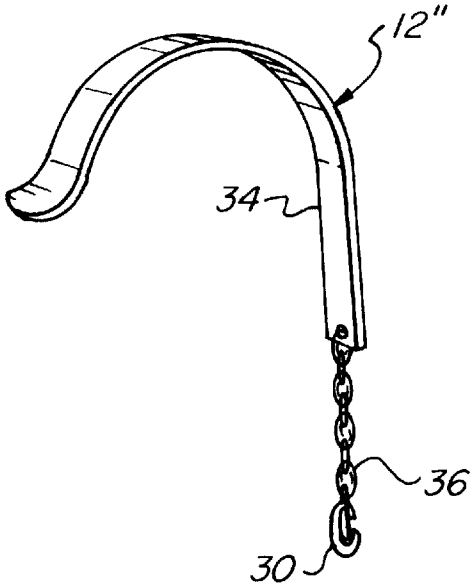
FIG. 6 is a perspective view of the second strap of the pack of FIG. 5.

FIGS. 5 and 6 depict another embodiment of the invention wherein pack 10 comprises a briefcase 10". The briefcase 10" includes a handle 28 and a first strap 11 which is attached to briefcase 10" on either side of handle 28. A second strap 12" for hooking over the user's shoulder and balancing the load of the case 10" may be detachably attached to briefcase 10" by a detachable connector 30,such as a hook. The handle that comprises the strap 12" is separate and distinct from the handle 28, which is present solely for the purpose of facilitating carrying of the bag by hand. As shown in the FIGS. 5 and 6, the second strap 12" is a multi-component device including a rigid shoulder hook 34 formed to fit over the user's shoulder and a linking component 36, such as a chain, for attaching the shoulder hook to the case 10". It is to be understood that the second strap 12" need not have multiple parts and may be a unitary device as well. Like bag 10', briefcase 10" need not include an internal shaft 20 or knob 22, but in all other respects includes features and advantages similar to those for pack 10.

Figure 7:
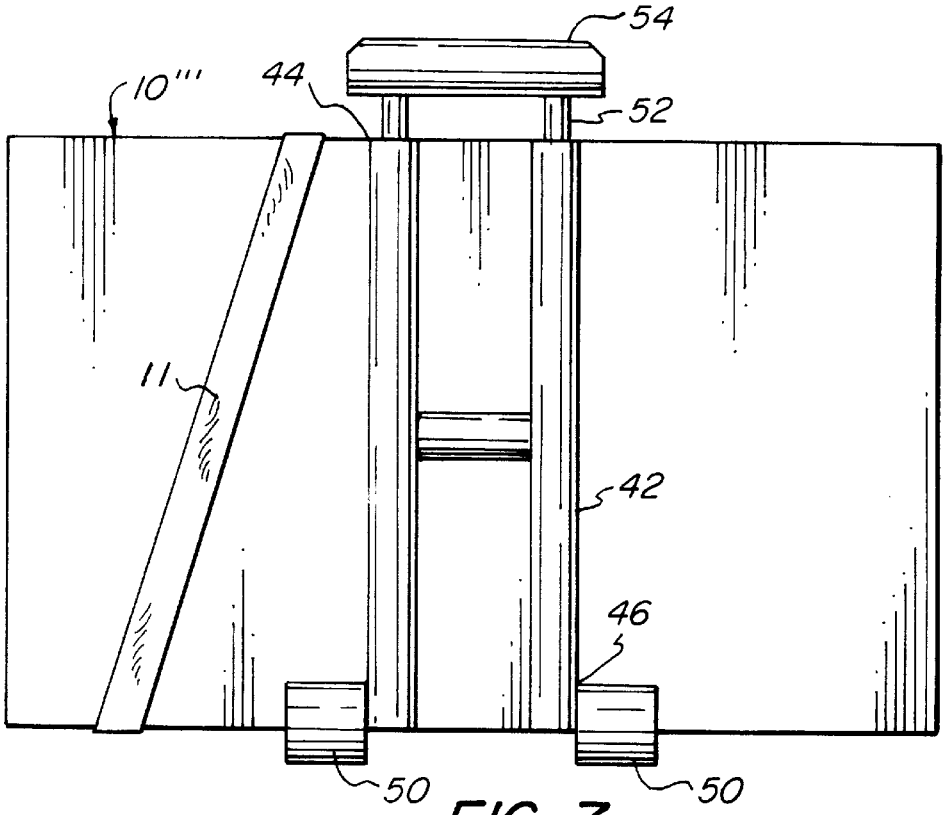
FIG. 7 is a rear view of an embodiment of the pack of FIG. 1 in the closed position.
Figure 8:
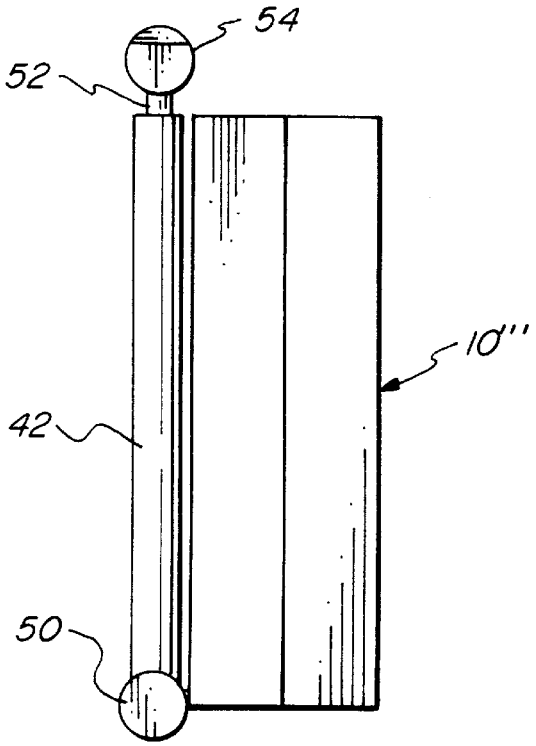
FIG. 8 is a side view of the pack of FIG. 7 in the closed position.
Figure 9:
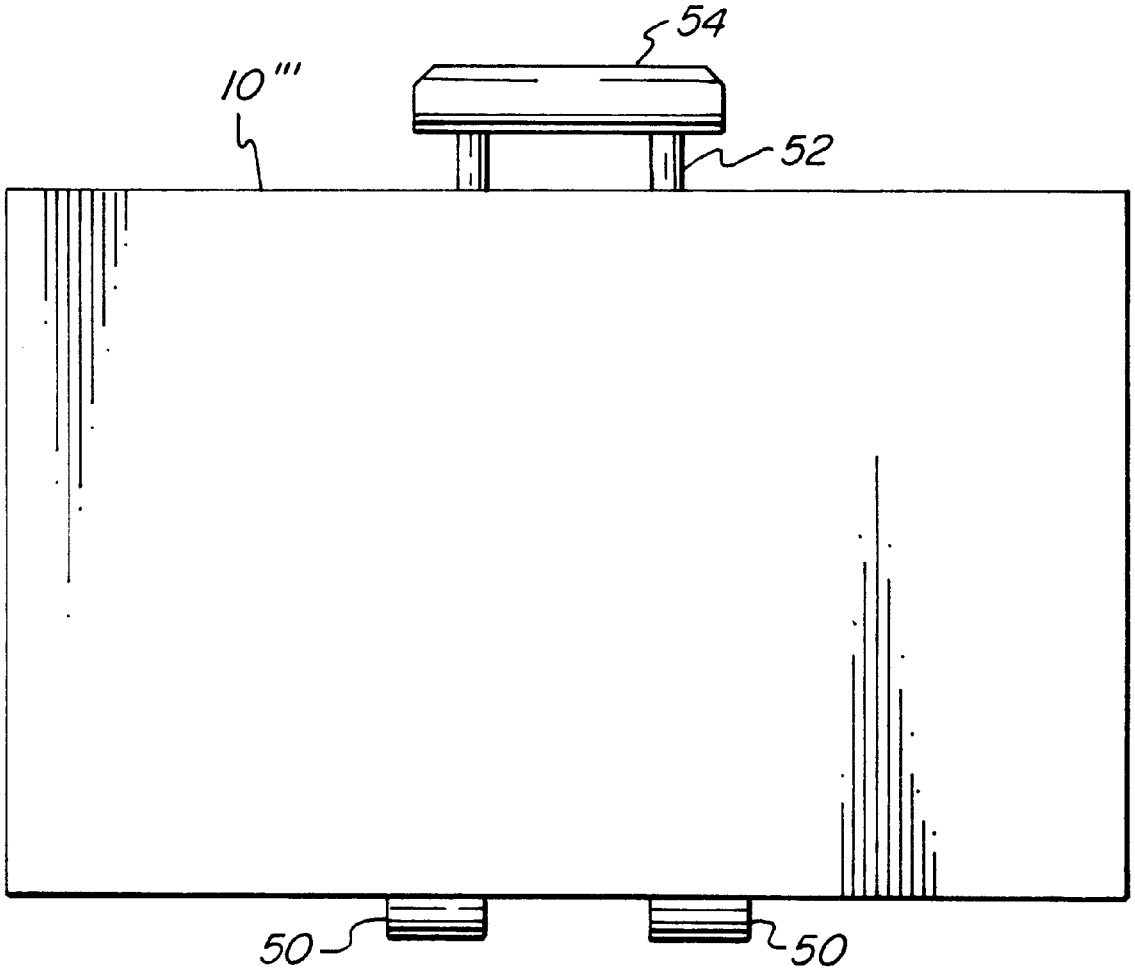
FIG. 9 is a front view of the pack of FIG. 7 in the closed position.
Figure 10:
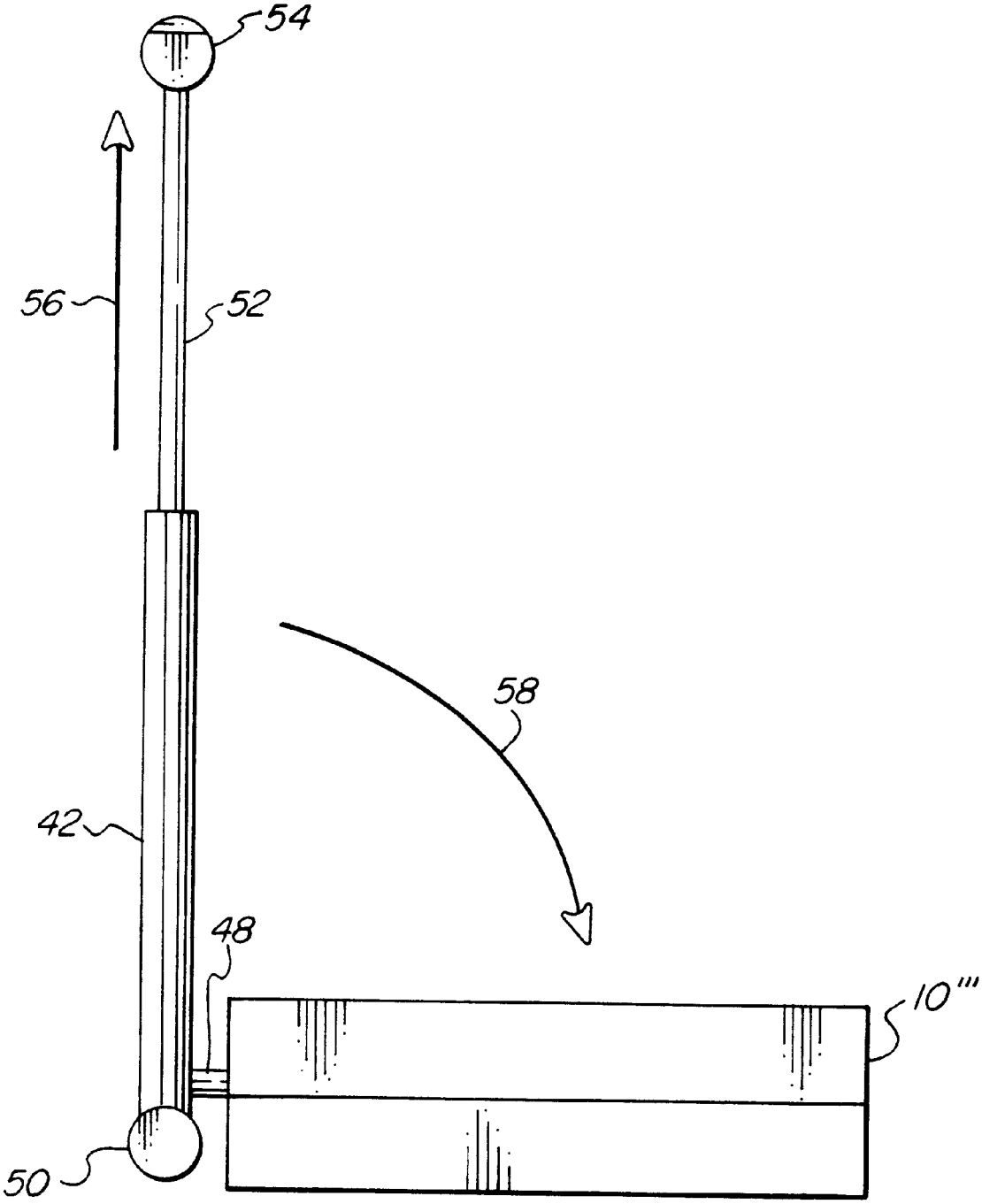
FIG. 10 is a side view of the pack of FIG. 7 in the open position.
Figure 11:
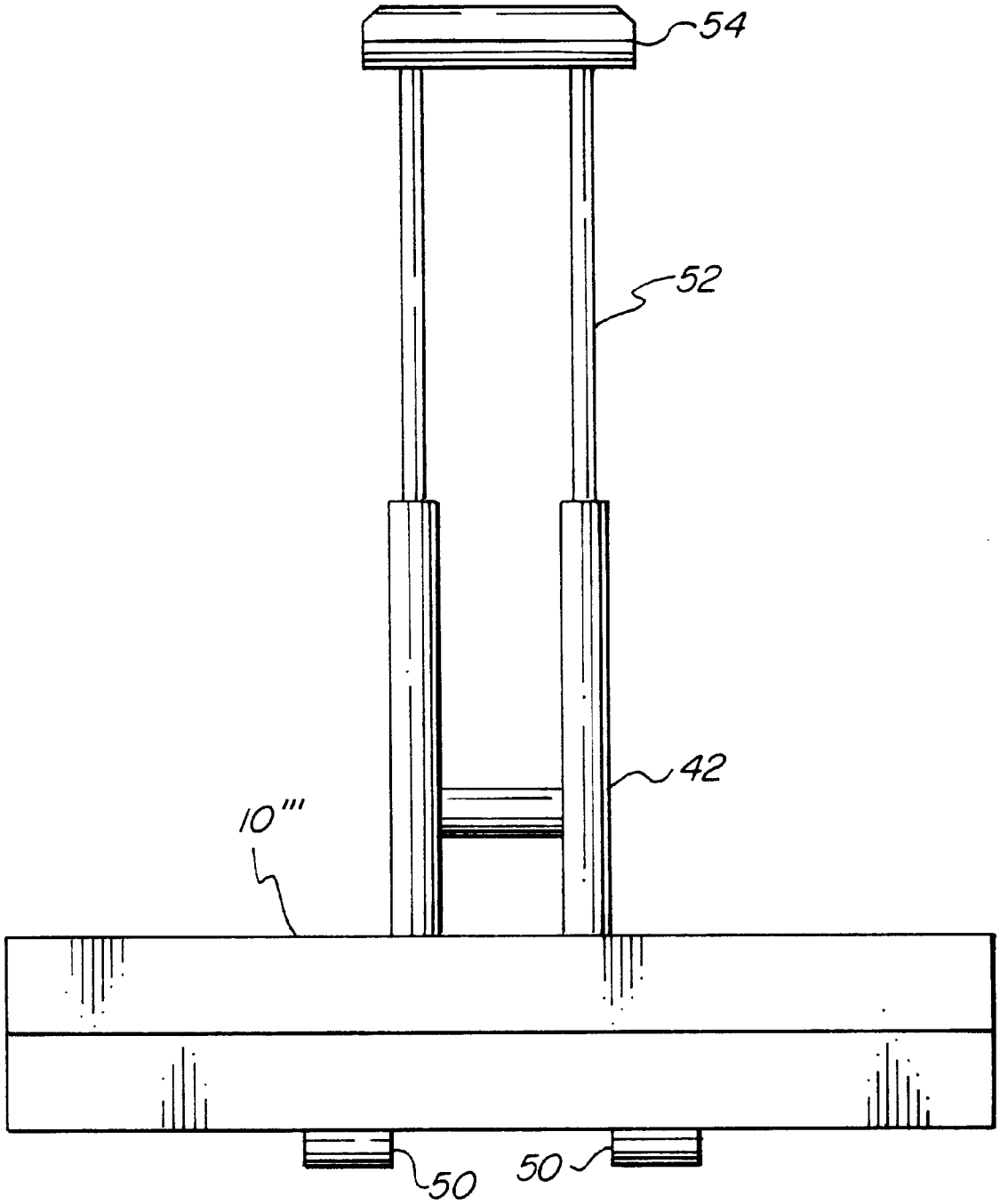
FIG. 11 is a front view of the pack of FIG. 7 in the open position.

FIGS. 7–10 depict another embodiment of the present invention wherein the pack 10 consists of a rigid briefcase 10". The briefcase 10" includes a frame 42 having an upper end 44 and a lower end 46. A handle 54 for carrying the case 10" is connected to the frame 42 at the upper end 44. The case 10" is hingedly connected to the lower end 46 of said frame 42 by a hinged connecting mechanism 48 that permits the case 10" to be moved between an open position, as shown in FIGS. 10 and 11, and a closed position, as shown in FIGS. 7–9. In the open position, the briefcase 10" is substantially perpendicular to the frame 42 providing a platform upon which the user 40 may place additional items or bags for transport. In the closed postion, the case 10" is substantially parallel and adjacent to the frame 42 and can thus be used as a normal briefcase carried by hand.

Preferably, the frame includes wheels 50 located at the lower end 46 of the frame 42 and a telescoping component 52 connecting the handle 54 to the frame 42 permitting the handle 54 to be moved from a retracted position to an extended position. In the retracted position, the handle 50 may be used as a normal handle for carrying the briefcase 10". In the extended position, the handle 54 and telescoping component 52 provide convenient leverage and height for ease of rolling the case on the wheels 50. As can be seen in FIG. 10, by moving the case 10" from the closed position to the open position, as shown by arrow 58, and moving the handle to the extended position, as shown by arrow 56, the briefcase 10" may be used to easily wheel around multiple items by placing them on the now flat briefcase 10" and pulling them by the handle 54. It is to be understood that the wheels 50 may be attached to the briefcase 10" rather than the frame to achieve the same result.

The briefcase 10" may also have a first strap 11 attached to a side thereof wherein the strap would permit the carrying of the briefcase on the shoulder of the user 40. The first strap could further be used to secure items placed on the briefcase 10" when in the open position. Additionally, similar to above, the handle 54 could be movable between a first position and a second position wherein said first position permits carrying of the briefcase 10" using said handle 54 and said second position permits said handle to be placed over a second shoulder of the user 40 to balance the load of the case 10" when the user 40 is utilizing the first strap to carry the briefcase 10" on the user's back. To enable the handle to be movable from the first position to the second position, the handle is detached at a first end and rotated about a joint or connector located at a second end in a manner akin to that shown in FIGS. 1 and 2. Once rotated to the second position, the handle can be hooked over the user's second shoulder in a manner similar to that shown in FIG. 5. It is to be understood that any of the embodiments described above for the second strap 12 could be implemented and used in this embodiment.

Although the invention has been described with reference to a particular arrangement of parts, features, and the like, these are not intended to exhaust all possible arrangements or features, and indeed many other modifications and variations will be ascertainable to those of skill in the art.

What is claimed is:

1. A device for carrying items comprising:

a frame having an upper end and a lower end a substantially rigid briefcase hingedly connected to said lower end of said frame and movable between an open position wherein said briefcase is substantially perpendicular to said frame and a closed position wherein said case is substantially parallel and adjacent to said frame;

said briefcase having a strap attached to a side thereof wherein said strap permits the carrying of the briefcase on a first shoulder of a user of the device;

a handle connected to said frame at said upper end; and, said handle movable between a first position and a second position wherein said first position permits carrying of the briefcase using said handle and said second position permits said handle to be placed over a second shoulder of the user.

2. The device of claim 1 further comprising a telescoping component connecting said handle to said frame wherein said telescoping component permits said handle to be moved from a retracted position to an extended position away from said briefcase.

3. The device of claim 1 further comprising wheels attached to said lower end of said frame to permit rolling of the device.

4. The device of claim 1 further comprising wheels attached to said briefcase to permit rolling of said device.

5. The device of claim 1 further comprising a telescoping component connecting said handle to said frame wherein said telescoping component permits said handle to be moved from a retracted position to an extended position away from said briefcase.

6. The device of claim 1 further comprising wheels attached to said lower end of said frame to permit rolling of the device.

7. The device of claim 1 further comprising wheels attached to said briefcase to permit rolling of said device.

8. A device for carrying items comprising:

a frame having an upper end and a lower end a handle connected to said frame at said upper end; and, a substantially rigid briefcase hingedly connected to said lower end of said frame and movable between an open position wherein said briefcase is substantially perpendicular to said frame and a closed position wherein said case is substantially parallel and adjacent to said frame.

9. A pack for transporting items comprising;

a compartment for holding items including a closable opening for permitting the insertion and removal of items;

a first strap attached to the compartment for carrying the pack on a first shoulder of a user of the pack; and, a second strap attached to the compartment movable between a first position and a second position wherein said first position permits said second strap to be located so as to permit said second strap to act as a handle for said pack and said second position for permitting said second strap to be placed over a second shoulder of the wearer to balance the pack.

10. The pack of claim 9 further wherein said second strap is attached to the compartment at a first end of said second strap via a rotatable pivot joint.

11. The pack of claim 10 further comprising an internal shaft attached at an upper end thereof to said pivot joint and terminating at a lower end in a knob near a lower end of the pack to enable the user to rotate said second strap between said first position and said second position.

12. The pack of claim 10 further comprising a latching mechanism attached to the pack for securing a second end of said second strap while said second strap is in said first position.

13. A device for carrying items comprising:

a container capable of receiving items and holding said items therein;

a first strap connected to said container, which strap is adapted to support said container on a first shoulder of a user of said device; and a handle connectable to said container, said handle having a first handle end, a second handle end, and a middle handle portion, which handle has a detachable section that, when detached, adapts said handle to receive additional support for said container from a second shoulder of said user.

14. The device of claim 13, wherein:

said handle is attached to said container by said first handle end;

said handle is further attached to said container by said second handle end;

said middle handle portion is attachable to said first strap; and said detachable section comprises said middle handle portion, which middle handle portion is detachable from said first strap.

15. The device of claim 14 wherein said container is a satchel.

16. The device of claim 13, further comprising:

a first handle connector attached to said container; and a second handle connector attached to said container;

wherein:

said first handle end is connected to said container with said first handle connector; and said detachable section comprises said second handle end, which end is detachable from said second handle connector and movable to a location enabling said handle to be used to receive additional support for said container from a second shoulder of said user.

17. The device of claim 16, wherein said container is a backpack.

18. The device of claim 16, wherein said container is a briefcase.

19. The device of claim 16, wherein said location comprises a supplemental handle connector, which connector is attached to said container.

20. The device of claim 16, wherein said first handle connector comprises a pivot.

21. The device of claim 20, wherein said pivot comprises:

a shaft having a top shaft end and a bottom shaft end, which shaft extends vertically along the interior of said pack;

a pivot joint located at said top shaft end, which joint is located at the top exterior of said container; and a knob located at said bottom shaft end, which knob is located at the bottom exterior of said container.

22. The device of claim 16, wherein:

said location comprises said second shoulder of said user; and said handle further comprises a hook shaped to fit on said second shoulder.

23. The device of claim 22 further comprising a cushioning strip attached to said handle.

24. The device of claim 22 wherein said first handle end is detachable from said container, such that said entire handle is detachable from said container.

25. The device of claim 22 further comprising a second handle attached to said container, which handle is shaped to facilitate carrying of the container by hand.

26. The device of claim 22, further comprising a frame, said frame having a frame top end and a frame bottom end, wherein said briefcase is hingedly connected to said frame bottom end and said handle is connected to said frame top end.

27. The device of claim 26, further comprising a telecsoping component connecting said handle to said frame.

28. The device of claim 26, further comprising at least one wheel connected to said briefcase.

29. The device of claim 26, further comprising at least one wheel connected to said frame bottom end.

* * * * *

UNITED STATES PATENT AND TRADEMARK OFFICE

CERTIFICATE OF CORRECTION

PATENT NO. : 6,488,189 B1
DATED : December 3, 2002
INVENTOR(S) : Wendell M. Smith It is certified that error appears in the above-identified patent and that said Letters Patent is hereby corrected as shown below:

Title page,
Item [54], should read:

-- [54] BACKPACKS, SHOULDER BAGS AND BRIEFCASES --

Signed and Sealed this

Fourth Day of March, 2003

JAMES E. ROGAN
*Director of the United States Patent and Trademark Office*